US005839503A

United States Patent [19]

Pleschiutschnigg

[11] Patent Number: 5,839,503

[45] **Date of Patent: *Nov. 24, 1998**

[54] METHOD AND CONTINUOUS CASTING FACILITY FOR GUIDING CONTINUOUSLY CAST METAL

[75] Inventor: Fritz-Peter Pleschiutschnigg, Duisburg, Germany

[73] Assignee: Mannesmann Aktiengesellschaft, Düsseldorf, Germany

[ * ] Notice: The term of this patent shall not extend beyond the expiration date of Pat. No. 5,730,207.

[21] Appl. No.: 682,708

[22] PCT Filed: Jan. 20, 1995

[86] PCT No.: PCT/DE95/00094

§ 371 Date: Jul. 29, 1996

§ 102(e) Date: Jul. 29, 1996

[87] PCT Pub. No.: WO95/20448

PCT Pub. Date: Aug. 3, 1995

[30] Foreign Application Priority Data

Jan. 28, 1994 [DE] Germany ..... 44 03 045.2

[51] Int. Cl.[6] ..... B22D 11/128; B22D 11/14; B22D 11/04

[52] U.S. Cl. ..... 164/484; 164/418; 164/436; 164/442; 164/459

[58] Field of Search ..... 164/418, 459, 164/491, 436, 442, 484

[56] References Cited

U.S. PATENT DOCUMENTS

| | | | |
|---|---|---|---|
| 4,926,930 | 5/1990 | Gay et al. | 164/418 |
| 4,955,428 | 9/1990 | Schrewe | 164/418 |
| 5,188,167 | 2/1993 | Perry et al. | 164/418 |
| 5,460,220 | 10/1995 | Coassin | 164/418 |

*Primary Examiner*—Joseph J. Hail, III
*Assistant Examiner*—I.-H. Lin
*Attorney, Agent, or Firm*—Cohen, Pontani, Lieberman, Pavane

[57] ABSTRACT

A continuous casting having a mold for producing strands in the form of slabs, thin slabs, blooms, and billets which results in a central running of the strand in the entire strand guide and in highly reliable casting at casting speeds of up to 6m/min. As a result of the cambered, concave shape of the mold and entire strand guide, the strand is guided coaxially to the entire strand guide from the cast surface until the strand exits at the delivery end of the continuous casting machine so that sideways movement of the entire strand in the direction of one of the narrow sides (snaking) is suppressed. This symmetrical running of the strand shell box to the mold and of the rest of the strand to the strand roll-guide results in a uniform symmetrical formation of the strand shell and its temperature field (isotherms), the withdrawal forces, and the loading of the strand shell in the region of the mold and the rest of the strand guide while at the same time ensuring that the strand runs centrally with reference to the center axis in the direction of the strand axes.

15 Claims, 3 Drawing Sheets

METHOD AND CONTINUOUS CASTING FACILITY FOR GUIDING CONTINUOUSLY CAST METAL

CROSS-REFERENCE TO RELATED APPLICATION

This application is a 371 of PCT/DE95/00094 filed Jan. 20 1995.

BACKGROUND OF THE INVENTION

1. Field of the Invention

The invention is directed to a continuous casting installation for guiding strands.

2. Description of the Prior Art

It is known from DE 39 07 351 A 1 to provide continuous casting installations for thin slabs with a funnel-shaped recess in their upper part, that is, in the region of the inlet cross section. This step influences the strand thickness, but has no effect on casting speed.

In the course of development, the following limiting values have taken shape for casting speed with standard strand formats:

- approximately 1.8–2.0 m/min for slabs with a thickness of (for example) 230 mm
- approximately 1.5–1.7 m/min for blooms with a thickness of (for example) 270 mm
- approximately 2.5 m/min for billets with a size of (for example) 100×100 mm.

When these maximum values are exceeded, there is a considerable increase in casting defects in the form of breakout. This is a result of the weaving motion of the strand in the strand guide which occurs at higher speeds. The strand oscillates back and forth in the direction of the narrow sides of the mold. This weaving motion results in nonuniform contact between the strand and the narrow sides of the mold and accordingly leads to asymmetrical heat transfer and to an asymmetrical isotherm profile in the strand shell in the casting direction and vertical thereto.

This disruption of the isotherms leads to stresses and different strand shell thicknesses and accordingly also to distortions of the strand shell which results in an increased breakout rate.

SUMMARY OF THE INVENTION

Therefore, the object of the present invention is to provide a continuous casting installation in which the weaving of the strand, also known in technical literature as "snaking", is prevented.

Pursuant to this object, and others which will become apparent hereafter, one aspect of the present invention resides in a continuous casting installation for guiding a cast strand, which casting installation includes a continuous casting mold having a height and an outlet opening, and a strand guide stand arranged downstream of the casting mold. The continuous casting mold includes a pair of cooled first side plates and a pair of second side plates which are arranged between the first side plates in a stationary or adjustable manner. The first side plates are cambered (i.e. concave). The camber extends from a vertical portion in an upper 80% of the mold height, preferably in the upper 30%, up to and including the mold outlet opening. The percentage of mold height being determined from the outlet opening, i.e., the mold inlet opening being at 100% of the mold height. The strand guide stand has support roll pairs which are arranged downstream of the continuous casting mold and are configured so that the camber of the mold continues into some of the support roll pairs.

In another embodiment of the invention the degree of shrinkage of the cast strand is taken into account in configuring the camber of the continuous casting mold and the support roll pairs.

In yet another embodiment of the invention the camber of the support roll pairs extends beyond the crater end of the strand.

Yet another embodiment of the invention provides that the camber extends as a concave shape from the start of one narrow side plate to the start of the other, opposite narrow side plate.

In still a further embodiment of the invention the concave shape extends linearly from a center axis in the direction of the narrow side plates.

In a further embodiment of the invention the concave shape extends non-linearly from the center axis toward the narrow side plates.

Still a further embodiment of the invention provides that the concave shape is formed from the center axis of the mold preceding from circle radii with a common turning point.

Still an additional embodiment of the invention provides that the concave shape extends from the center axis of the mold along only a part of the length of the broad-side plates of the mold which length corresponds to the minimum cast width of a narrowest cast strand. The broad-side plates run parallel in the region of the minimum width and the maximum width of cast strands of different width. The narrow side plates are adjustable to different widths of the cast strand in this region.

In yet a further embodiment of the invention the broad side plates run linearly and at an angle in the regions of the minimum width and the maximum width so as to reduce the strand thickness outwardly.

In a further embodiment of the invention the concave shape of the broad side plates and the support roll pairs in the strand guide has a height in a region of the center axis which is at most 5% of the strand thickness at the transitional region of the minimum width and the maximum width of the cast strand.

In still another embodiment of the invention the concave shape of the broad-side plates first begins in the region of transition between the mold outlet opening of the continuous casting mold and the strand guide and continues only in the direction of strand travel.

In still a further embodiment of the invention the concave shape and the strand guide stand is created by bending the cylindrical rolls in their elastic range under a casting load to a height in the region of the center axis which is at most 5% of the strand thickness.

BRIEF DESCRIPTION OF THE DRAWINGS

The drawings serve to illustrate the invention.

DETAILED DESCRIPTION OF THE PREFERRED EMBODIMENTS

The invention consists in that a guiding and centering of the strand is ensured by means of the concave strand guide in the region of the mold and by the accordingly convex strand resulting in an area-specific uniform contact of the strand in the mold so that a high degree of symmetry is ensured in the formation of the strand shell with respect to heat transfer, isotherm profile, and strand shell profile.

This shape of the stand guide and its influence on a uniform formation of the strand shell results in the surprising effect that the casting speed for the strand formats mentioned above can be increased up to 6 m/min.

Figure 1:
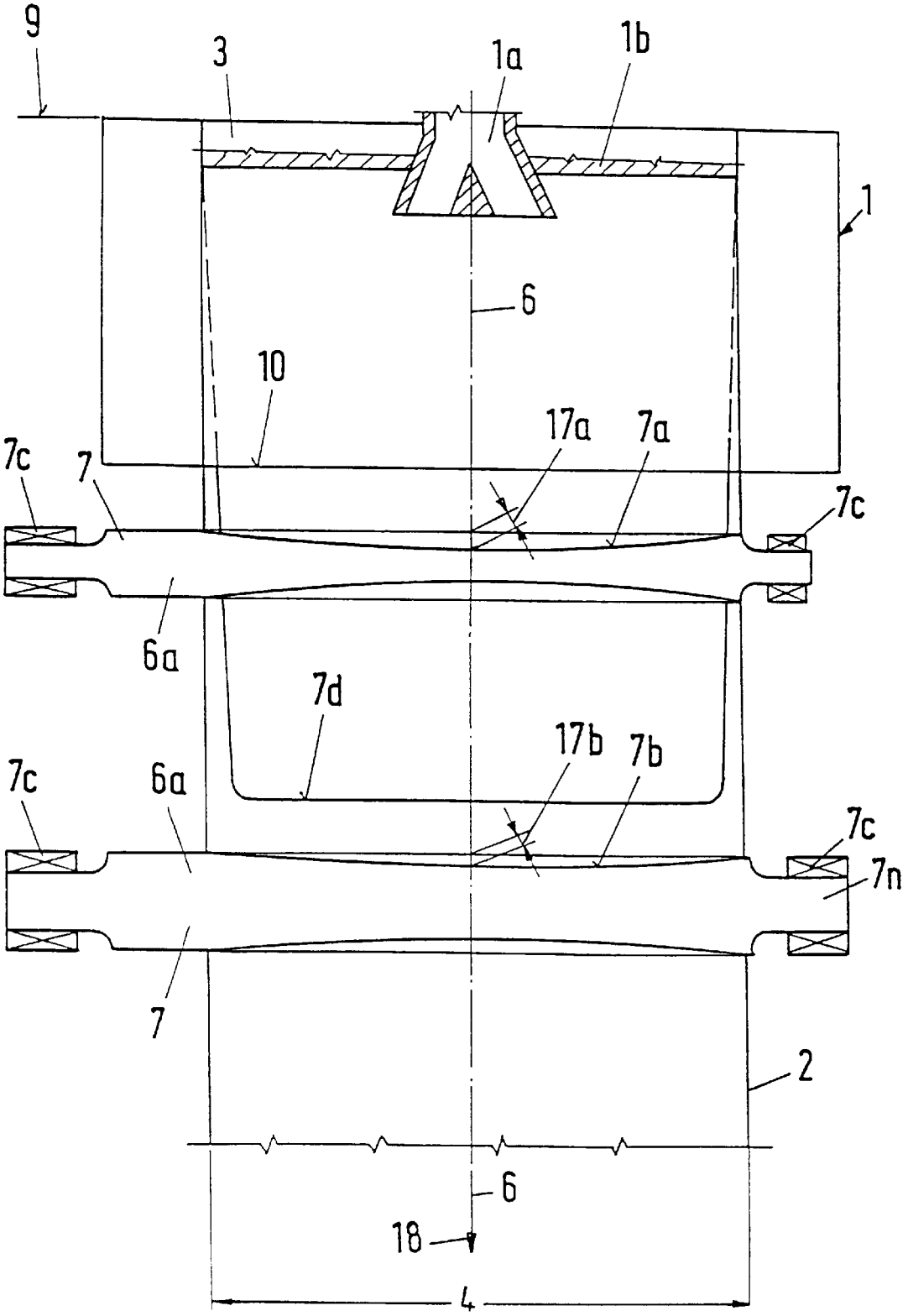
FIG. 1 shows a section through a mold with strand guide in the casting direction pursuant to the present invention.
Figure 2:
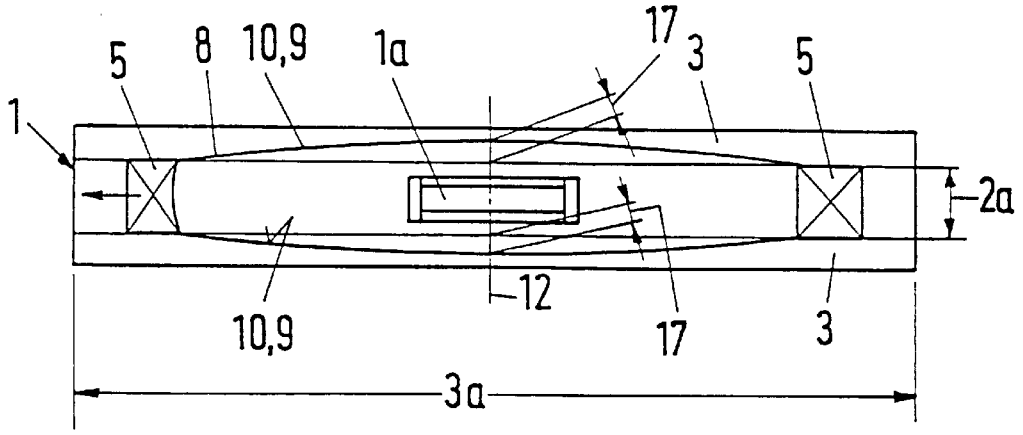
FIG. 2 shows a horizontal section through a mold.
Figure 3:
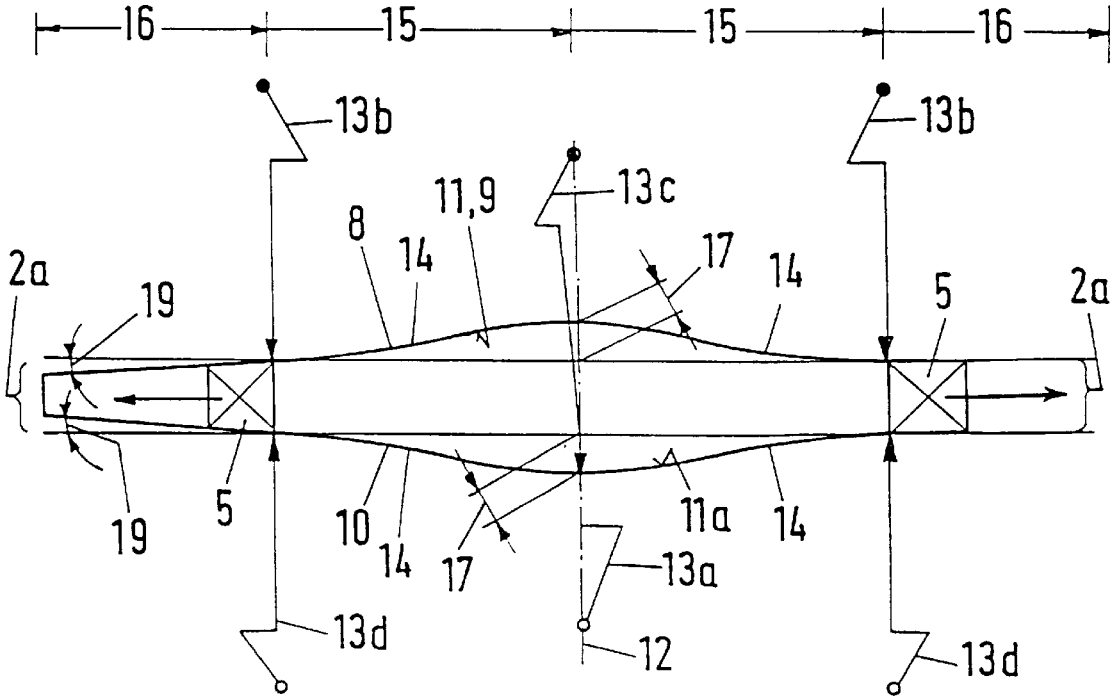
FIG. 3 shows a horizontal section through a mold.

A slabbing installation is described by way of example in FIGS. 1 to 3. The slabbing installation comprises a mold (1) with an adjustable width, whose broad side-plates (3) have a concave (i.e. cambered) shape (f) extending symmetrically with reference to the center axis (12) of the mold. This shape is constant from the upper edge (9) of the mold to the outlet (10) of the mold and, beyond this, up to the final roll (7*n*) of the strand guide. The concavity or convex slab has a maximum height (17) of 5% of the slab thickness in relation to the thickness (2*a*) of the stand (2).

In the adjusting region (16) of the narrow side plates (5) of the mold, the profile extends linearly in a parallel manner or at an inclination angle α (19) not exceeding 2°, as shown in FIG. 3. defined by the narrow side-plates (5). In other words, the slab has a cover height (17) from the surface of the strand as defined by the narrow side plates (5) that is 5% of the strand thickness (2*a*).

The shape of the mold in the concave region may or may not be linear symmetrically with respect to the center axis (12) and the axis (6) of the guidance of the strand. In the present example, an immersion nozzle (*a*) and casting powder (*b*) are used for casting. Of course, casting is also possible within the scope of the invention without an immersion nozzle and casting powder.

The constant concavity of the broad sides which is predetermined in the mold is continued in the strand guide by means of rolls which are noncylindrical (concave)(7*a*,7*b*) or which bend under load in the elasticity range up to the last roll (7*n*) of the strand guide which-at the maximum possible casting speed - can be reached by the crater end (7*d*), The support roll pair 7 has rolls with different concave shapes (7*a*, 7*b*), respectively. The rolls are supported in bearings (7*c*). The support roll pair serves as a guide (6*a*) for the strand.

The strand proceeds through the mold in the direction 18. The narrow side plates 5 are set to define the strand width 4, as shown in FIG. 1. Meanwhile, FIG. 2 shows the length 3a of the broad-side plates 3.

FIG. 3 illustrates the adjustment range of the side plates 5. The side plates can be adjusted to define a minimum width 15 of the strand and a maximum width 16+15. The concave shape 11, 11*a* of the broad-side plate of the mold can also be seen in this figure. 13*a*, 13*c* represent the concave circle radius at the center of the mold while 13*b*, 13*d* indicate the concave circle radius at the outerside of the mold. The concave shape is formed from the center axis 12 preceding from the circle radii 13 *a–d* with a common turning point 14.

Figure 4:
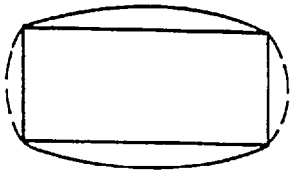
FIG. 4 shows a bloom form.
Figure 5:
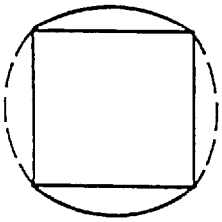
FIG. 5 shows a billet form.

An appropriate shape can also be selected for blooms (FIG. 4) and billets (FIG. 5). For this purpose, two opposite sides or all four sides of the strand can have a convex shape in the mold and can be maintained constant until the end of the continuous casting machine.

I claim:

1. A continuous casting installation for guiding a cast strand, comprising:

a continuous casting mold having a height and an outlet opening, the continuous casting mold comprising a pair of cooled first side plates and second side plates having arranged between the first side plates, the first side plates having cambered surfaces, that extend vertically from a vertical point located in an upper 80% of the mold height up to and including the mold outlet opening, the cambered surfaces of the first side plates being configured to have a concave shape that extends horizontally from a first one of the second side plates to a second one of the second side plates, the second plates being narrow-side plates; and a strand guide stand having support roll pairs arranged downstream of the continuous casting mold and constructed to have a contour shape confirms to cambered shape of the first side plate surfaces.

2. A continuous casting installation according to claim 1, wherein the second side plates are stationary between the first side plates.

3. A continuous casting installation according to claim 1, wherein the second side plates are arranged to be adjustable between the first side plates so as to permit adjustment to a strand width.

4. A continuous casting installation according to claim 1, wherein the camber extends from a point in the upper 30% of the mold height.

5. A continuous casting installation according to claim 1, wherein the camber of the first side plates and the support roll pairs is configured to take into account a degree of shrinkage of the strand.

6. A continuous casting installation according to claim 1, wherein the strand guide stand is configured so that the camber of the support roll pairs extends beyond a crater end of the strand.

7. A continuous casting installation according to claim 1, wherein the concave shape extends linearly from a center axis of the mold toward the narrow side plates.

8. A continuous casting installation according to claim 1, wherein the concave shape extends non-linearly from a center axis of the mold toward the narrow side plates.

9. A continuous casting installation according to claim 1, wherein the concave shape is formed from a center axis of the mold preceding from circle radii with a common turning point.

10. A continuous casting installation according to claim 1, wherein the first side plates are broad-side plates which have a length, the concave shape extending from a center axis of the mold along only a portion of the length of the broad-side plates which corresponds to a minimum cast width of a narrowest cast strand, the broad-side plates being arranged to run parallel in regions of the minimum width and maximum width of casted strands of different width, the narrow side plates being adjustable to different widths of the cast strand in this region.

11. A continuous casting installation according to claim 10, wherein the broad-side plates are configured to run linearly and at an angle in the regions of minimum width and maximum width so as to reduce the strand thickness outwardly.

12. A continuous casting installation according to claim 10, wherein the concave shape of the broad-side plates and the support roll pairs in the strand guide has a height in a region of the center axis which is at most 5% of the strand thickness at a transitional region between the minimum width and maximum width of the strand.

13. A continuous casting installation according to claim 1, wherein the broad-side plates are configured so that the concave shape begins in a region of transition between the mold outlet opening of the continuous casting mold and the strand guide stand and continues only in a direction of strand movement.

14. A continuous casting installation according to claim 1, wherein the support roll pairs are cylindrical and configured so as to bend in an elastic range under casting load so as to form the concave shape.

15. A process for producing a strand with a thickness of 40 to 400 mm, comprising the steps of:

providing a continuous casting mold having a height and outlet opening, the continuous casting mold comprising a pair of first side plates and a pair of second side plates arranged between the first side plates so as to define a strand width, the first side plates having cambered surfaces, the cambered surfaces extending vertically from a vertical point in an upper 80% of the mold height up to and including the mold outlet opening, the cambered surfaces of the first side plates being configured to have a concave shape that extends horizontally from a first one of the second side plates to a second one of the second side plates, the second plates being narrow-side plates, arranging a strand guide stand downstream of the continuous casting mold, the strand guide stand having support roll pairs configured to have a contour shape confirms to the cambered shape of the first side plate surfaces of the casting mold; and providing molten metal to the mold for producing a cast strand having a thickness of 40–400 mm.

* * * * *